United States Patent [19]

Orihashi et al.

[11] Patent Number: 4,673,486

[45] Date of Patent: Jun. 16, 1987

[54] PROCESS FOR THERMAL CRACKING OF RESIDUAL OILS

[75] Inventors: Tadaaki Orihashi; Hiroshi Tsuji; Kazuhiko Ogawa; Masao Hayashitani; Seiji Terada, all of Kobe; Tsugio Miyagawa, Toke; Hideo Isozaki, Yachiyo, all of Japan

[73] Assignee: Jushitsuyu Taisaku Gijutsu Kenkyu Kumiai, Tokyo, Japan

[21] Appl. No.: 654,506

[22] Filed: Sep. 26, 1984

[30] Foreign Application Priority Data

Sep. 30, 1983 [JP] Japan ..... 58-183261

[51] Int. Cl.[1] ..... C10C 3/08; C10G 55/04

[52] U.S. Cl. ..... 208/86; 208/106; 208/107; 208/128; 208/130; 208/132

[58] Field of Search ..... 208/86, 106, 107, 125, 208/128, 130, 132, 95

[56] References Cited

U.S. PATENT DOCUMENTS

| | | | |
|---|---|---|---|
| 3,310,484 | 3/1967 | Mason et al. | 208/128 |
| 3,549,519 | 12/1970 | Munro et al. | 208/125 |
| 3,669,876 | 6/1972 | Berger | 208/87 |
| 3,928,170 | 12/1975 | Takahashi et al. | 208/40 |
| 4,039,429 | 8/1977 | Van Klinken et al. | 208/86 |
| 4,169,782 | 10/1979 | Thompson | 208/102 |
| 4,214,979 | 7/1980 | Nakanishi et al. | 208/128 |
| 4,257,871 | 3/1981 | Wernicke et al. | 208/86 |
| 4,324,642 | 4/1982 | Durai-Swamy | 208/8 |
| 4,391,700 | 7/1983 | Billon et al. | 208/86 |
| 4,400,264 | 8/1983 | Kwant et al. | 208/86 |
| 4,405,441 | 9/1983 | Van Dongen et al. | 208/86 |
| 4,428,824 | 1/1984 | Choi et al. | 208/86 |
| 4,469,587 | 9/1984 | Tailleur et al. | 208/107 |
| 4,500,416 | 2/1985 | Van Dongen et al. | 208/86 |
| 4,514,283 | 4/1985 | Closmann et al. | 208/86 |

FOREIGN PATENT DOCUMENTS

| | | | |
|---|---|---|---|
| 082555 | 6/1983 | European Pat. Off. . | |
| 2215432 | 10/1972 | Fed. Rep. of Germany . | |
| 3434819 | 4/1985 | Fed. Rep. of Germany | 208/132 |
| 50-36441 | 11/1975 | Japan . | |

*Primary Examiner*—Andrew H. Metz
*Assistant Examiner*—Anthony McFarlane
*Attorney, Agent, or Firm*—Marshall, O'Toole, Gerstein, Murray & Bicknell

[57] ABSTRACT

An extraction residue obtained by solvent deasphalting of a residual oil is mixed with a carrier gas and thermally cracked at a temperature of 400° C. to 600° C. in a tube-type cracking apparatus to obtain cracked oil and pitch. The use of the carrier gas, which may be either an inert gas such as nitrogen or a reactive gas such as hydrogen, permits a flow velocity through the cracking apparatus sufficient to substantially prevent coking. Preferably, the cracking conditions are controlled so that the yield of cracked oil is not more than about 30 to 35%.

14 Claims, 5 Drawing Figures

PROCESS FOR THERMAL CRACKING OF RESIDUAL OILS

The present invention relates to an improved process for thermal conversion or cracking of petroleum hydrocarbon residual oils.

Presently, residual oils such as vacuum distillation tower bottoms are overproduced in petroleum refineries and they are mainly used as paving asphalt whose commercial value is usually very low. Accordingly, various attempts have been made to recover deasphalted oils from residual oils by using solvent deasphalting processes. However, the application of solvent deasphalting processes poses a problem of finding an economically feasible use for the extraction residue. The extraction residue alone is too hard to be used for paving, and the application of thermal cracking or reforming to produce artificial caking coal additives and cracked oils has not been economical due to limitations of existing equipment.

In accordance with the present invention, it has been found that the extraction residue from such solvent deasphalting processes can be thermally cracked to obtain valuable products by mixing or commingling the extraction residue feedstock with a suitable carrier gas and passing the resultant fluid mixture through a thermal cracking zone at selected thermal cracking conditions. More specifically, the feedstock-carrier gas mixture is passed through a tube-type thermal cracking apparatus and is subjected to a temperature of from about 400° C. to about 600° C. for a time sufficient to effect thermal cracking of the feedstock. In general, the residence time should not be more than about 8 minutes. The use of the carrier gas provides an increased flow velocity through the thermal cracking zone sufficient to minimize or substantially prevent coking of the extraction residue while at the same time obtaining high yields of cracked oil and pitch which are of excellent quality. If desired, an additive oil, such as gas oil or cracked oil, may be mixed with the extraction residue feedstock to adjust the viscosity and improve fluidity.

Although the invention is broadly applicable to the treatment of any extraction residue from solvent deasphalting of a residual oil, the preferred material for use in the present invention contains about 40% or more asphaltenes or pentane-insolubles and is obtained by extracting a petroleum hydrocarbon residual oil with butane, pentane, or hexane as a single or a mixed solvent.

In one embodiment of the invention the extraction residue feedstock is passed through the cracking apparatus together with a substantially inert carrier gas, such as nitrogen, steam, cracked gas, or mixtures thereof. In this embodiment cracked oils consisting mostly of light fractions are obtained together with high quality pitches due to the fact that the extraction residue feedstock produces much of the cracked oil during the early stage of the reaction. In another embodiment of the invention the extraction residue feedstock is passed through the cracking apparatus together with a relatively reactive gas, particularly hydrogen or a hydrogen-containing gas. In this embodiment desulfurization of the cracked oil and the pitch, as well as upgrading of the cracked oil due to hydrocracking, are achieved in addition to the ordinary thermal cracking reactions.

The invention will now be explained in more detail with reference to the accompanying drawings in which:

As previously mentioned, the feedstock or raw material used in the process of the present invention is preferably an extraction residue obtained by treating residual oils of petroleum origin, e.g. topped crude, vacuum residue, other refinery residual oils, heavy crude oil, or tar sand, in a solvent deasphalting step using butane, pentane, hexane, or mixtures thereof. Extraction residues with at least about 40% asphaltene content or pentane-insolubles (softening point of 80° to 220° C.) can be used, but those with from about 60% to about 80% asphaltene content or pentane-insolubles (softening point of 120° to 160° C.) are more desirable from an economic viewpoint.

Figure 1:
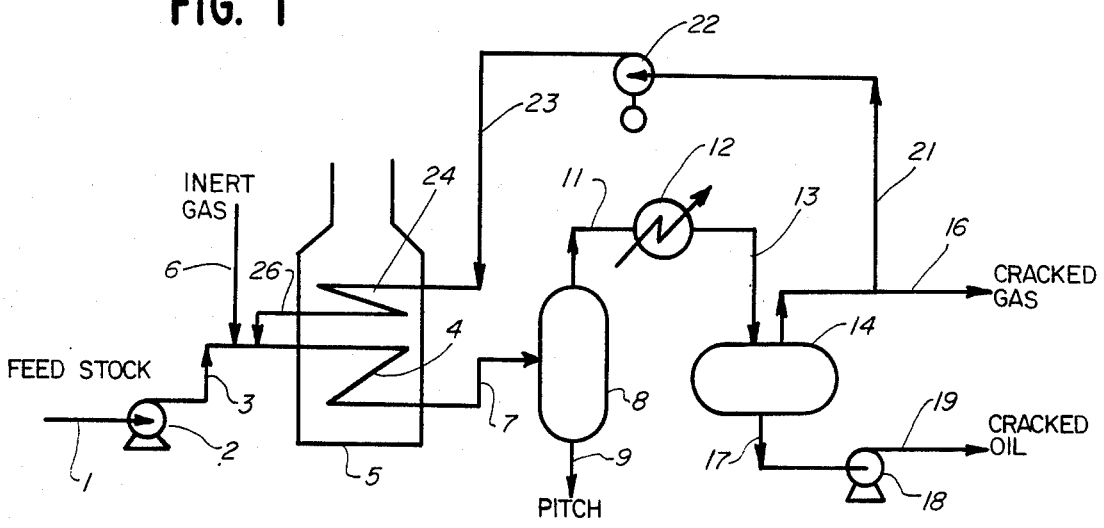
FIG. 1 is a flow sheet showing an apparatus for carrying out a process in accordance with one embodiment of the present invention.

Referring to FIG. 1, the extraction residue feedstock is supplied by an inlet line 1 to a feed pump 2 and is discharged through a line 3 into the tubular coil or cracking zone 4 of a tube-type thermal cracking furnace 5. Prior to introduction into the cracking zone 4, the feedstock is mixed with a relatively inert carrier gas, e.g. nitrogen, steam, cracked gas, or mixtures thereof, introduced through a line 6 into the line 3. The heat input to the cracking zone 4, the flow velocity of the feedstock-carrier gas mixture through the cracking zone 4, and the residence time are correlated to achieve thermal cracking of the feedstock at a temperature ranging from about 400° C. to about 600° C. The residence time should not be more than about 8 minutes.

The effluent from the zone 4 is introduced by a line 7 into a knockout drum 8 and is separated into pitch removed through a line 9 and a cracked oil—cracked gas mixture removed through a line 11. The cracked oil—cracked gas mixture is condensed in a condenser 12. The condenser effluent is passed through a line 13 to a separator 14. Cracked gas is removed through a line 16, and cracked oil product is removed through a line 17 by a pump 18 discharging through a line 19. When cracked gas is used as the carrier gas, the cracked gas from line 16 may be circulated by a line 21, a compressor 22, and line 23 to a preheating coil 24 in the furnace 5. The preheated gas is removed from the coil 24 and introduced through a line 26 into the line 3 for admixture with the feedstock.

Figure 2:
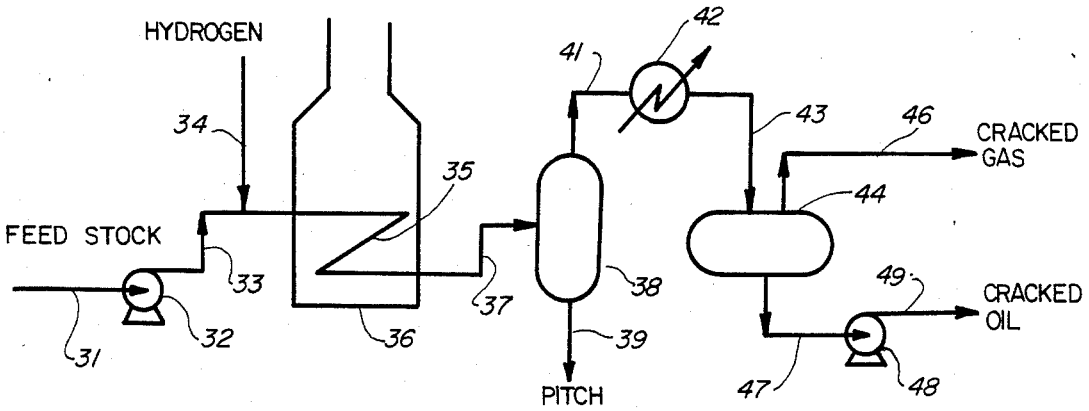
FIG. 2 is a flow sheet showing an apparatus for carrying out a process in accordance with another embodiment of the invention.

In FIG. 2, the process is essentially the same except that hydrogen is used as the carrier gas mixed with the feedstock. The feedstock passes through an inlet line 31 to the feed pump 32 and is discharged through a line 33 where hydrogen gas is introduced through a line 34. The resultant fluid mixture passes through a tubular coil or cracking zone 35 in the furnace 36. The effluent stream passes through a line 37 to the knockout drum 38 where pitch is withdrawn through a line 39 and a cracked oil—cracked gas mixture is removed through a line 41 and passed to a condenser 42. The condenser effluent passes through a line 43 to a separator 44. Cracked gas containing hydrogen sulfide and any excess unreacted hydrogen is removed through a line 46, and the cracked oil product is withdrawn through a line 47, a pump 48, and a line 49.

Because of the presence of hydrogen, the reactions that occur in the zone 35 include desulfurization and hydrocracking or hydroreforming in addition to thermal cracking. Consequently, the cracked oil product recovered at line 49 has a lower viscosity and a lower sulfur content, and the pitch recovered at line 39 also has a lower sulfur content. The sulfur is removed principally as hydrogen sulfide which concentrates in the cracked gas stream removed at line 46.

In general, it is desirable to preheat the carrier gas, e.g. to a temperature of from about 100° C. to about 400° C., before the gas is mixed with the extraction residue feedstock. In FIG. 1, it will be understood that the preheated inert gas is introduced through the line 6, and in the case where cracked gas is used, the recirculated cracked gas is preheated in the coil 24. In FIG. 2, it will also be understood that the preheated hydrogen gas is introduced through the line 34.

The amount of carrier gas mixed with the feedstock is such as to provide an increased flow velocity of the fluid through the heated tubular cracking zone sufficient to minimize or substantially prevent coking. The flow velocity of the fluid mixture at the entrance or inlet of the tubular cracking zone will usually be from about 0.5 to about 4.0 m/sec, preferably from about 1.5 to about 2.0 m/sec. When hydrogen or a hydrogen-containing gas is used as the carrier gas, coke formation is prevented more effectively because of the accompanying hydrodesulfurization and hydroreforming reactions.

In order to adjust the viscosity and improve the fluidity of the extraction residue feedstock, any suitable additive oil may be used if desired. For example, gas oils with boiling points in a range of from about 200° C. to about 400° C. or cracked oils generated in the process by the thermal cracking of the feedstock may be used as the additive oil. The amount of the additive oil to be used depends upon the viscosity of the feedstock. In general, it is desirable to use the minimum amount of additive oil required to provide a viscosity such that the feed pump can be operated effectively.

The reasons for choosing the reaction temperature range of from about 400° C. to about 600° C. in the present invention are that the cracking reactions take an excessively long time to complete at temperatures below about 400° C. and excessive coking occurs at temperatures above about 600° C.

In the present invention, heating of the tube-type cracking zone may be effected by any of the conventional heating methods, such as direct heating by firing, indirect heating with a combustion gas, steam or hot gas, and electric heating. In order to avoid coking troubles which may occur during heating of extra-heavy feedstocks, it is desirable to limit the heat flux in the tube-type cracking zone to a range of from about 5,000 to about 40,000 kcal/m$^2$ hr, preferably to a range of from about 10,000 to about 20,000 kcal/m$^2$ hr. Also, the difference between the outside surface temperature of the cracking tube and the temperature of the fluid flowing through the tube should be less than about 100° C., preferably not more than about 20° C.

Figure 3:
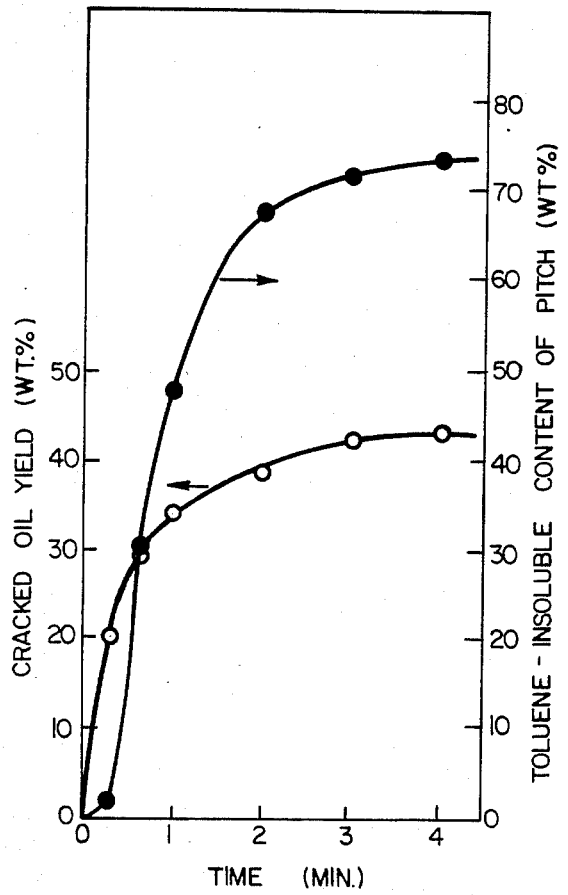
FIGS. 3 through 5 are graphs showing the results of experiments conducted in accordance with the present invention.

The main advantage of the present invention, i.e. the economical production of cracking oil at high yields and good quality pitch from extraction residue feedstocks, was first confirmed by batch type experiments. In the experiments, the feedstock (shown in Table 1) was put into a small reactor vessel of 30 ml, and a cracking reaction was started by introducing the reaction vessel into a molten lead bath. After the required reaction was completed, the reaction vessel was cooled rapidly to stop the reaction, and the reaction products were analyzed. The data obtained from an experiment at a reaction temperature of 475° C. are shown in FIG. 3. This diagram shows that the yield of cracked oil increased rapidly during the early stage of the reaction and its rate of increase dropped after the cracked oil yield reached the range of from about 30% to about 35%. Accordingly, it is not economical to try to obtain more cracked oil by maintaining the reaction for a longer time since the cracked oil yield will not increase appreciably in relation to the amount of thermal energy consumed. On the other hand, although the toluene-insoluble content of the pitch is almost nil during the initlal stage of cracking, a rapid formation is observed at a point when the cracked oil yield reaches around 30% to 35%.

Figure 4:
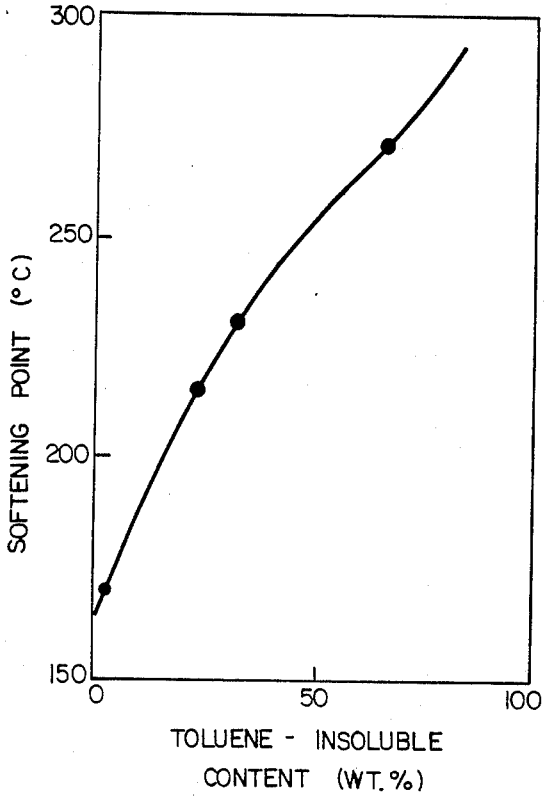

As shown in FIG. 4, the toluene-insoluble content of thermal cracking pitch is correlated with the softening point of the pitch. Consequently, it is advisable to restrict the toluene-insoluble content of the pitch to about 30% or less so as to facilitate withdrawal of the pitch from the knockout drum by gravity. When the cracked oil yield is not greater than about 30 to 35%, this condition is met. Accordingly, in practicing the invention the most economical results will be obtained by controlling the thermal cracking conditions so that the cracked oil yield is kept at not more than about 30 to 35% and the toluene-insoluble content of the pitch is restricted to about 30% or less.

The cracked oil obtained by the method of the present invention has charcteristics close to those of gas oil and it is of good quality with low sulfur content and, in most cases, almost no heavy metals such as nickel and vanadium. This cracked oil can be used as a raw material for desulfurization or for catalytic cracking units and it has a wide range of applications for the production of gasoline, petrochemical raw materials and fuel oil. On the other hand, as the pitch obtained by the present invention preferably has about 30% or less toluene-insolubles and no quinoline-insolubles, it has adequate fluidity and can be easily withdrawn from the knockout drum. The pitch may be used as a solid fuel or raw material for gasification without further treatment. Because of its excellent coking properties, the pitch can also be used as an artifical caking or agglutinating material for addition to coals used in the production of blast furnace or metallurgical coke.

The following non-limiting specific examples are presented for the purpose of further explanation of the invention.

EXAMPLE 1

An extraction residue feedstock was obtained by extracting the mixed vacuum distillation residues of Arabian heavy and Khafji crudes using n-pentane as the solvent. The feedstock properties are shown in Table 1.

TABLE 1

| Specific gravity | 1.11 | Elemental analysis [d. a. f.] (%) | |
|---|---|---|---|
| Softening point (°C.) | 140 | C | 82.5 |
| Proximate analysis (%) | | H | 8.6 |
| Ash content | <0.1 | N | 0.4 |
| Volatile matter | 60.7 | S | 7.0 |
| Fixed carbon | 39.3 | C/H | 0.81 |

TABLE 1-continued

| | | | |
|---|---|---|---|
| Component analysis (%) | | Nickel content (ppm) | 114 |
| Asphaltene content | 69.6 | Vanadium content (ppm) | 384 |
| Oil content | 20.5 | | |
| Resin content | 9.9 | | |

The feedstock was first mixed with gas oil at 190° C. so that the concentration of the gas oil in the mixture was 30% by weight. This mixture was then passed at a flow rate of approximately 10 l/hr through a tube 5 mm in inner diameter and 29 m in length which was installed in an electrically heated furnace with hot air circulation. Nitrogen gas preheated to 190° C. was introduced into the mixture in the tube at the entrance of the furnace. In Tests Nos. 1–3, the furnace temperature was adjusted so that the fluid temperatures at the furnace outlet were 450° C., 470° C. and 500° C., respectively. The operating conditions and the product yields are shown in Table 2.

TABLE 2

| Test No. | 1 | 2 | 3 |
|---|---|---|---|
| Operating conditions | | | |
| Furnace temperature (°C.) | 479 | 506 | 545 |
| $N_2$ gas flow rate (Nl/hr) | 377 | 377 | 1,300 |
| Fluid temperature at furnace outlet (°C.) | 450 | 470 | 500 |
| Maximum outside surface temperature of the tube (°C.) | 464 | 488 | 523 |
| Residence time (sec) | 11 | 10 | 4 |
| Tube inlet velocity (m/sec) | 1.5 | 1.3 | 3.9 |
| Products | | | |
| $CH_4$ (wt %) | 0.07 | 0.19 | 0.36 |
| $C_2H_6$ (wt %) | 0.08 | 0.22 | 0.45 |
| $C_3H_8$ (wt %) | 0.10 | 0.30 | 0.58 |
| $C_4H_{10}$ (wt %) | 0.10 | 0.27 | 0.50 |
| $H_2S$ (wt %) | 0.10 | 0.29 | 0.44 |
| Cracked oil (wt %) | 5.8 | 20.3 | 27.5 |
| Pitch (wt %) | 93.7 | 78.4 | 70.2 |

Figure 5:
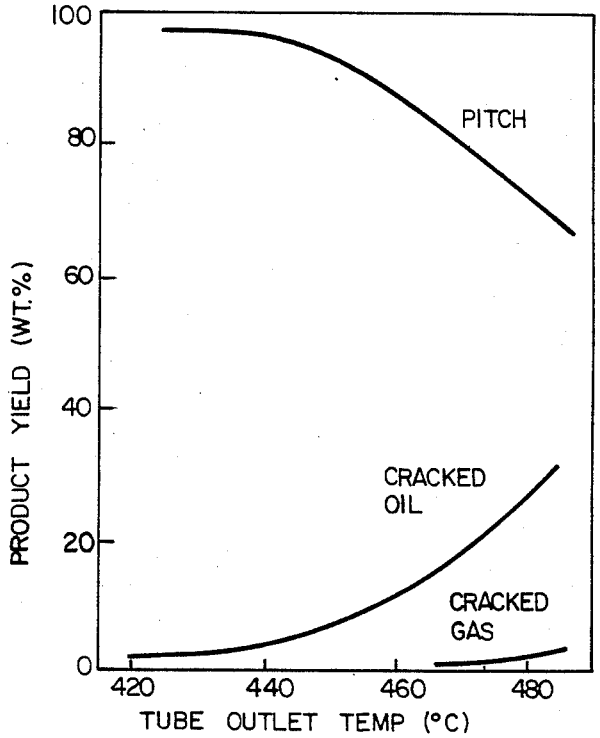

The fluid from the furnace was led into a knockout drum to separate pitch from cracked gas and cracked oil, and pitch was withdrawn from the bottom by gravity. To prevent pitch from solidifying, the knockout drum was heavily insulated and the temperature was kept at 350° C. The cracked oil separated in the knockout drum was condensed and recovered by a condenser, and the cracked gas was discharged into an exhaust gas line together with the nitrogen gas. The properties of the cracked oil are shown in Table 3, and the properties of the pitch are shown in Table 4. Changes in yield of each product for various reaction temperatures are shown in FIG. 5 for the case when the residence time of the fluid in the tube was 10 seconds.

TABLE 3

| Test No. | 1 | 2 | 3 |
|---|---|---|---|
| Specific gravity (15/4° C.) | 0.869 | 0.899 | 0.905 |
| CCR (carbon residue) | 2.01 | 2.04 | 2.06 |
| Elemental analysis | | | |
| C (%) | 80.1 | 82.2 | 82.6 |
| H (%) | 14.0 | 12.4 | 11.1 |
| N (%) | 0.11 | 0.14 | 0.14 |
| S (%) | 4.30 | 3.80 | 3.72 |
| C/H | 0.48 | 0.55 | 0.62 |
| Ash content (%) | Trace | Trace | Trace |
| N—heptane-insolubles (%) | 0.1 or less | 0.1 or less | 0.1 or less |
| Ni (ppm) | 1 or less | 1 or less | 1 or less |
| V (ppm) | 1 or less | 1 or less | 1 or less |

TABLE 3-continued

| Test No. | 1 | 2 | 3 |
|---|---|---|---|
| Bromine number | 46 | 49 | 63 |
| Distillation characteristics | | | |
| 20% (°C.) | 221 | 242 | 246 |
| 40% (°C.) | 268 | 287 | 296 |
| 60% (°C.) | 310 | 335 | 346 |
| 80% (°C.) | 350 | 400 | 402 |

TABLE 4

| Test No. | 1 | 2 | 3 |
|---|---|---|---|
| Specific gravity | 1.14 | 1.17 | 1.22 |
| Softening point (°C.) | 150 | 165 | 230 |
| Ash content (wt %) | 0.3 | 0.3 | 0.3 |
| Elemental analysis | | | |
| C (%) | 82.8 | 82.9 | 83.5 |
| H (%) | 8.3 | 7.7 | 7.0 |
| N (%) | 0.81 | 0.83 | 0.99 |
| S (%) | 6.70 | 7.02 | 7.59 |
| C/H | 0.83 | 0.90 | 0.99 |
| Solvent extraction | | | |
| Pentane-insolubles (wt %) | 65.4 | 72.0 | 76.0 |
| Toluene-insolubles (wt %) | 0.3 | 1.7 | 30.1 |
| Roga index | 69.8 | 73.9 | 75.6 |

EXAMPLE 2

The same apparatus and feedstock described in Example 1 were used. In this example hydrogen gas, which was preheated to 190° C., accompanied the feedstock in place of nitrogen gas. The tube inlet velocity was 3.7 m/sec. The other operating conditions and the product yields are shown in Table 5. Table 6 shows the properties of the cracked oil, and Table 7 shows the properties of the pitch.

TABLE 5

| Test No. | 4 |
|---|---|
| Operating conditions | |
| Furnace temperature (°C.) | 529 |
| $H_2$ gas flow rate (Nl/hr) | 1,200 |
| Fluid temperature at furnace outlet (°C.) | 490 |
| Maximum outside surface temperature of the tube (°C.) | 525 |
| Residence time (sec) | 5 |
| Properties | |
| $CH_4$ (wt %) | 0.40 |
| $C_2H_6$ (wt %) | 0.52 |
| $C_3H_8$ (wt %) | 0.65 |
| $C_4H_{10}$ (wt %) | 0.62 |
| $H_2S$ (wt %) | 1.30 |
| Cracked oil (wt %) | 28.5 |
| Pitch (wt %) | 68.0 |

TABLE 6

| Test No. | 4 |
|---|---|
| Specific Gravity (15/4° C.) | 0.902 |
| CCR (carbon residue) | 1.75 |
| Elemental analysis | |
| C (%) | 82.0 |
| H (%) | 11.5 |
| N (%) | 0.12 |
| S (%) | 3.55 |
| C/H | 0.59 |
| Ash content (%) | Trace |
| N—heptane-insolubles (%) | 0.1 or less |
| Ni (ppm) | 0.1 or less |
| V (ppm) | 0.1 or less |
| Bromine number | 51 |
| Distillation characteristics | |

TABLE 6-continued

| Test No. | 4 |
|---|---|
| 20% (°C.) | 225 |
| 40% (°C.) | 272 |
| 60% (°C.) | 311 |
| 80% (°C.) | 367 |

TABLE 7

| Test No. | 4 |
|---|---|
| Specific gravity | 1.19 |
| Softening point (°C.) | 215 |
| Ash content (wt %) | 0.3 |
| Elemental analysis | |
| C (%) | 83.0 |
| H (%) | 7.6 |
| N (%) | 0.90 |
| S (%) | 7.0 |
| C/H | 0.91 |
| Solvent extraction | |
| Pentane-insolubles (wt %) | 73.5 |
| Toluene-insolubles (wt %) | 25.0 |
| Roga index | 75 |

EXAMPLE 3

Tests Nos. 5–7 were made using the same apparatus and feedstock described in Example 1. Nitrogen preheated to 190° C. was also used as the carrier gas, and gas oil was mixed with the feedstock so that the gas oil concentration (wt%) in the mixture was 30%, 20%, and 10% in Runs 5, 6, and 7, respectively. The other operating conditions and the product yields are shown in Table 8. The properties of the cracked oil and the pitch are shown in Tables 9 and 10, respectively.

TABLE 8

| Test No. | 5 | 6 | 7 |
|---|---|---|---|
| Operating conditions | | | |
| Furnace temperature (°C.) | 527 | 527 | 535 |
| $N_2$ gas flow rate (Nl/hr) | 377 | 377 | 377 |
| Fluid temperature at furnace outlet (°C.) | 497 | 496 | 497 |
| Maximum outside surface temperature of the tube (°C.) | 516 | 512 | 516 |
| Residence time (sec) | 6 | 7 | 8 |
| Tube inlet velocity (m/sec) | 1.6 | 1.5 | 1.4 |
| Products | | | |
| $CH_4$ (wt %) | 0.51 | 0.42 | 0.34 |
| $C_2H_6$ (wt %) | 0.65 | 0.49 | 0.42 |
| $C_3H_8$ (wt %) | 0.85 | 0.70 | 0.59 |
| $C_4H_{10}$ (wt %) | 0.71 | 0.58 | 0.52 |
| $H_2S$ (wt %) | 0.65 | 0.79 | 0.42 |
| Cracked oil (wt %) | 32.9 | 29.6 | 27.9 |
| Pitch (wt %) | 63.7 | 67.7 | 69.8 |

TABLE 9

| Test No. | 5 | 6 | 7 |
|---|---|---|---|
| Specific gravity (15/4° C.) | 0.897 | 0.904 | 0.884 |
| CCR (carbon residue) | 1.67 | | 0.75 |
| Elemental analysis | | | |
| C (%) | 83.6 | 84.2 | 83.2 |
| H (%) | 11.9 | 11.8 | 11.5 |
| N (%) | 0.13 | 0.16 | 0.15 |
| S (%) | 3.31 | 3.50 | 3.51 |
| C/H | 0.58 | 0.60 | 0.60 |
| Ash content (%) | Trace | Trace | Trace |
| N—heptane-insolubles (%) | 0.21 | 0.12 | 0.14 |
| Ni (ppm) | Less than 1 | Less than 1 | Less than 1 |
| V (ppm) | 2.2 | 3.5 | 1.3 |
| Bromine number | 63 | 57 | 63 |
| Distillation characteristics | | | |
| 20% (°C.) | 247 | 231 | 186 |
| 40% (°C.) | 315 | 331 | 273 |
| 60% (°C.) | 350 | 370 | 350 |
| 80% (°C.) | 394 | 417 | 404 |

TABLE 10

| Test No. | 5 | 6 | 7 |
|---|---|---|---|
| Specific gravity | 1.22 | 1.22 | 1.23 |
| Softening point (°C.) | 240 | 235 | 230 |
| Ash content (wt %) | 0.2 | 0.2 | 0.2 |
| Elemental analysis | | | |
| C (%) | 82.4 | 82.5 | 82.2 |
| H (%) | 6.8 | 6.7 | 6.5 |
| N (%) | 1.04 | 1.05 | 1.05 |
| S (%) | 7.97 | 8.95 | 9.22 |
| C/H | 1.02 | 1.03 | 1.05 |
| Solvent extraction | | | |
| Pentane-insolubles (wt %) | 78.4 | 77.7 | 77.7 |
| Toluene-insolubles (wt %) | 29.1 | 27.6 | 26.7 |
| Roga index | 76.9 | 76.1 | 75.5 |

We claim:

1. A process for the thermal cracking of an extraction residue from a solvent deasphalting process, which comprises:

providing said extraction residue by solvent extraction of a petroleum hydrocarbon residual oil with a solvent selected from the group consisting of butane, pentane, hexane, and mixtures thereof under conditions such that the extraction residue contains at least about 40% asphaltenes or pentane-insolubles, and subjecting said extraction residue to thermal cracking by a method consisting essentially of the following steps:

(a) commingling said extraction residue with a carrier gas;

(b) passing the resultant fluid mixture through a tubular thermal cracking zone at thermal cracking conditions, including a temperature of from about 400° C. to about 600° C. and a residence time not more than about 8 minutes to effect thermal cracking of said extraction residue;

(c) regulating the amount of said carrier gas to provide a flow velocity of said fluid mixture at the inlet of said tubular thermal cracking zone of from about 0.5 to about 4.0 m/sec, providing heat input to said tubular thermal cracking zone such that the heat flux is from about 5,000 to about 40,000 kcal/m$^2$hr, and maintaining a temperature difference between the outside surface of said tubular thermal cracking zone and the fluid mixture flowing therethrough of less than about 100° C., whereby to minimize or avoid coking in said cracking zone; and (d) separating and recovering cracked oil and pitch from the effluent reaction products from said thermal cracking zone, the wt.% yield of cracked oil being substantially less than the wt.% yield of pitch.

2. The process of claim 1 wherein said extraction residue contains from about 60% to about 80% asphaltene or pentane-insolubles.

3. The process of claim 1 wherein said extraction residue is mixed with an additive oil to adjust its viscosity and improve its fluidity.

4. The process of claim 3 wherein said additive oil is gas oil or cracked oil.

5. The process of claim 1 wherein said flow velocity is from about 1.5 to about 2.0 m/sec.

6. The process of claim 1 wherein said heat flux is from about 10,000 to about 20,000 kcal/m$^2$hr and said temperature difference is not more than about 20° C.

7. The process of claim 1 wherein said thermal cracking conditions are controlled so that the yield of said cracked oil is not more than about 30 to 35%.

8. The process of claim 1 wherein said carrier gas comprises a substantially inert gas.

9. The process of claim 1 wherein said carrier gas is selected from the group consisting of nitrogen, steam, cracked gas, and mixtures thereof.

10. The process of claim 1 wherein said carrier gas comprises hydrogen or a hydrogen-containing gas whereby desulfurization and hydrocracking or hydroreforming reactions also occur in said thermal cracking zone.

11. The process of claim 1 wherein said carrier gas is preheated to a temperature of from about 100° C. to about 400° C.

12. The process of claim 4 wherein the amount of said gas oil or cracked oil is not more than about 30% by weight of the mixture.

13. The process of claim 7 wherein said pitch has a toluene-insoluble content of about 30% or less whereby to facilitate gravity withdrawal of said pitch from a separation vessel that receives the effluent reaction products from said thermal cracking zone.

14. A process for the thermal cracking of an extraction residue from a solvent deasphalting process, which comprises:

providing said extraction residue by solvent extraction of a petroleum hydrocarbon residual oil with a solvent selected from the group consisting of butane, pentane, hexane, and mixtures thereof under conditions such that the extraction residue contains from about 60% to about 80% asphaltenes or pentane-insolubles, and subjecting said extraction residue to thermal cracking by a method consisting essentially of the following steps:

(a) mixing said extraction residue with an additive oil in an amount not more than about 30% by weight of the mixture to improve the fluidity of the extraction residue;

(b) commingling the mixture of extraction residue and additive oil with a carrier gas;

(c) passing the resultant fluid mixture through a tubular thermal cracking zone at thermal cracking conditions, including a temperature of from about 400° C. to about 600° C. and a residence time not more than about 8 minutes to effect thermal cracking of said extraction residue to cracked oil and pitch;

(d) controlling said thermal cracking conditions so that the yield of said cracked oil is not more than about 30 to 35% and said pitch has a toluene insoluble content of about 30% or less;

(e) regulating the amount of said carrier gas to provide a flow velocity of said fluid mixture at the inlet of said tubular thermal cracking zone of from about 0.5 to about 4.0 m/sec, regulating the heat input to said tubular thermal cracking zone so that the heat flux is from about5,000 to about 40,000 kcal/m$^2$hr, and maintaining a temperature difference between the outside surface of said tubular thermal cracking zone and the fluid mixture flowing therethrough of less than about 100° C., whereby to minimize or avoid coking in said cracking zone; and (f) separating and recovering cracked oil and pitch from the effluent reaction products from said thermal cracking zone, the wt.% yield of cracked oil being substantially less than the wt.% yield of pitch.

* * * * *